US007473075B2

(12) United States Patent
Huang et al.

(10) Patent No.: US 7,473,075 B2
(45) Date of Patent: Jan. 6, 2009

(54) LIQUID PUMP

(75) Inventors: Ching-Hsing Huang, Guangdong (CN); Wun-Chang Shih, Guangdong (CN); Chien-Long Hong, Guangdong (CN); Huan-Chao Lin, Guangdong (CN); Wei-Ben Wang, Guangdong (CN); Fong-Tan Yu, Guangdong (CN); Hsien-Sheng Pei, Guangdong (CN)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 391 days.

(21) Appl. No.: 11/308,148

(22) Filed: Mar. 8, 2006

(65) Prior Publication Data

US 2007/0020129 A1 Jan. 25, 2007

(30) Foreign Application Priority Data

Jul. 22, 2005 (CN) ..... 2005 1 0036140

(51) Int. Cl.
*F04D 19/00* (2006.01)

(52) U.S. Cl. ..... 415/221; 417/352

(58) Field of Classification Search ..... 415/104, 415/214.1, 221; 417/354, 353, 352, 349
See application file for complete search history.

(56) References Cited

U.S. PATENT DOCUMENTS

| | | | | |
|---|---|---|---|---|
| 6,068,455 | A | 5/2000 | Cowans | |
| 6,626,649 | B2 | 9/2003 | Cowans | |
| 2004/0017954 | A1 * | 1/2004 | Komori et al. | 384/100 |

FOREIGN PATENT DOCUMENTS

| | | | |
|---|---|---|---|
| JP | 2001-165085 | | 6/2001 |
| JP | 2004176659 | A * | 6/2004 |

* cited by examiner

*Primary Examiner*—Edward Look
*Assistant Examiner*—Dwayne J White
(74) *Attorney, Agent, or Firm*—Winston Hsu

(57) ABSTRACT

A liquid pump (100) includes a top cover (40), a back plate (50), and a spacing member (60). The spacing member is sandwiched between the top cover and the back plate, thereby dividing an interior of the liquid pump into a fluid chamber (14) and a receiving cavity (16) isolated and hermetical from the fluid chamber. The fluid chamber is disposed between the top cover and the spacing member for receiving therein a fluid dynamic bearing (70) and a rotor (20) which drives working fluid to enter and leave the liquid pump. The receiving cavity is disposed between the spacing member and the back plate for receiving therein a stator (30) which drives the rotor to rotate in respective to the bearing.

15 Claims, 3 Drawing Sheets

LIQUID PUMP

FIELD OF THE INVENTION

The present invention relates generally to a liquid pump, and more particularly to a liquid pump of a liquid cooling system for cooling an electronic package.

DESCRIPTION OF RELATED ART

With continuing development of the computer technology, electronic packages such as CPUs are generating more and more heat that is required to be dissipated immediately. The conventional heat dissipating devices such as combined heat sinks and fans are not competent for dissipating so much heat any more. Liquid cooling systems have thus been increasingly used in computer technology to cool these electronic packages.

A typical liquid cooling system includes a heat-absorbing unit for absorbing heat from the electronic package, and a heat dissipating unit which is filled with liquid. The liquid conducts heat exchange with the heat absorbing unit and the surrounding environment, thereby taking the heat away the heat-absorbing unit to the surrounding environment as the liquid is circulated to cool the electronic package. Typically, a pump is used to circulate the liquid.

The pump comprises an inlet for inputting the liquid and an outlet for outputting the liquid. The inlet and outlet are in communication with an inner space of the pump where a rotor having blades is installed. The rotor is pivotably mounted to a bearing hole of a ball bearing, so that the pump is capable of driving the liquid to circulate in the liquid cooling system.

A problem existing in the liquid cooling system is that in operation of the pump a friction is caused in the bearing. The friction will generate a noise and decrease lifetime of the bearing, which in turn will decrease lifetime of the pump. Thus, a pump with a long life and low noise is needed in the liquid cooling system.

SUMMARY OF INVENTION

The present invention relates to a liquid pump of a liquid cooling system for cooling an electronic package. According to a preferred embodiment of the present invention, the liquid pump includes a top cover, a back plate, and a spacing member. The spacing member is sandwiched between the top cover and the back plate, thereby dividing an interior of the liquid pump into a fluid chamber and a receiving cavity isolated and hermetical from the fluid chamber. The fluid chamber is disposed between the top cover and the spacing member for receiving therein a fluid dynamic bearing and a rotor which drives working fluid to enter and leave the liquid pump through inlet and outlet defined in the top cover. The receiving cavity is disposed between the spacing member and the back plate for receiving therein a stator which drives the rotor to rotate in respective to the bearing.

Other advantages and novel features of the present invention will become more apparent from the following detailed description of preferred embodiment when taken in conjunction with the accompanying drawings, in which:

DETAILED DESCRIPTION

Figure 1:
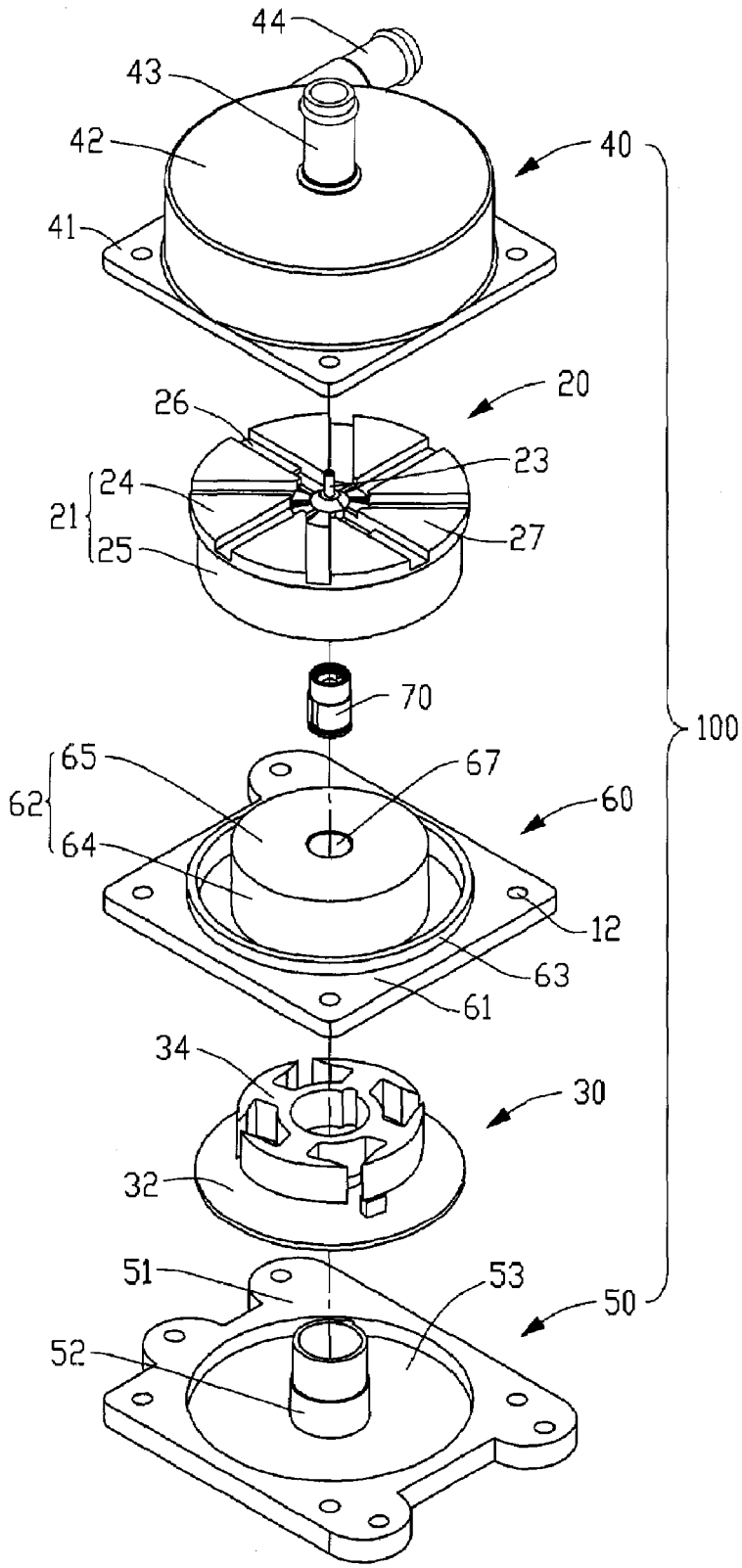
FIG. 1 is an exploded, isometric view of a liquid pump according to a preferred embodiment of the present invention.
Figure 2:
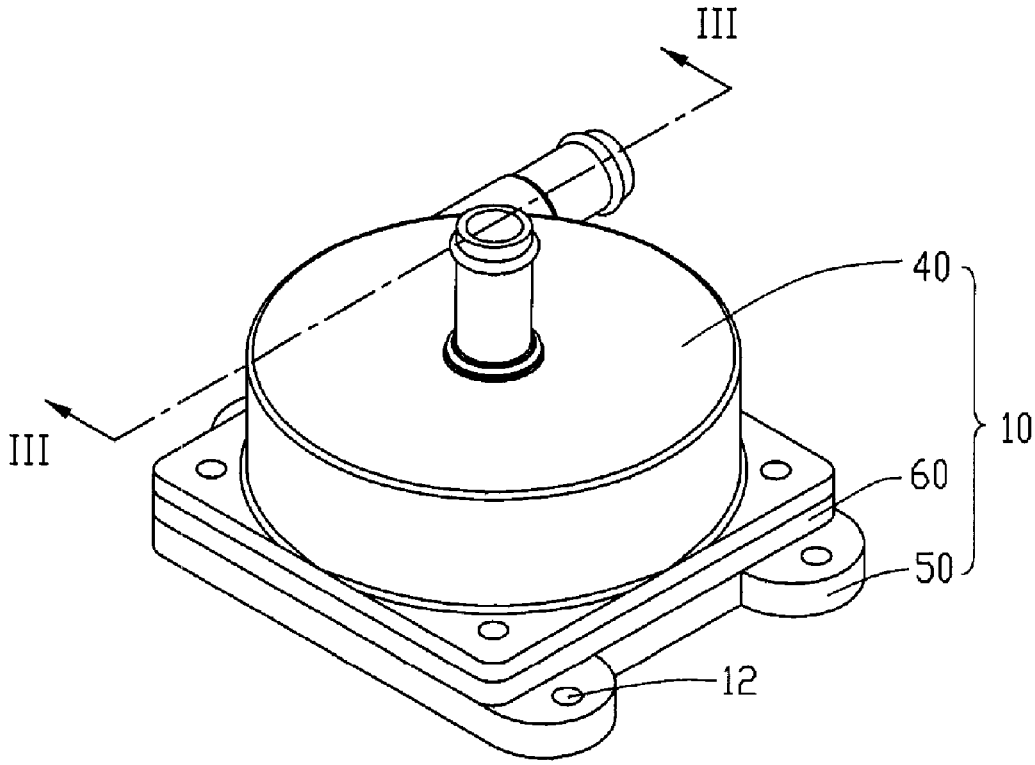
FIG. 2 is an assembled view of the liquid pump of FIG. 1.
Figure 3:
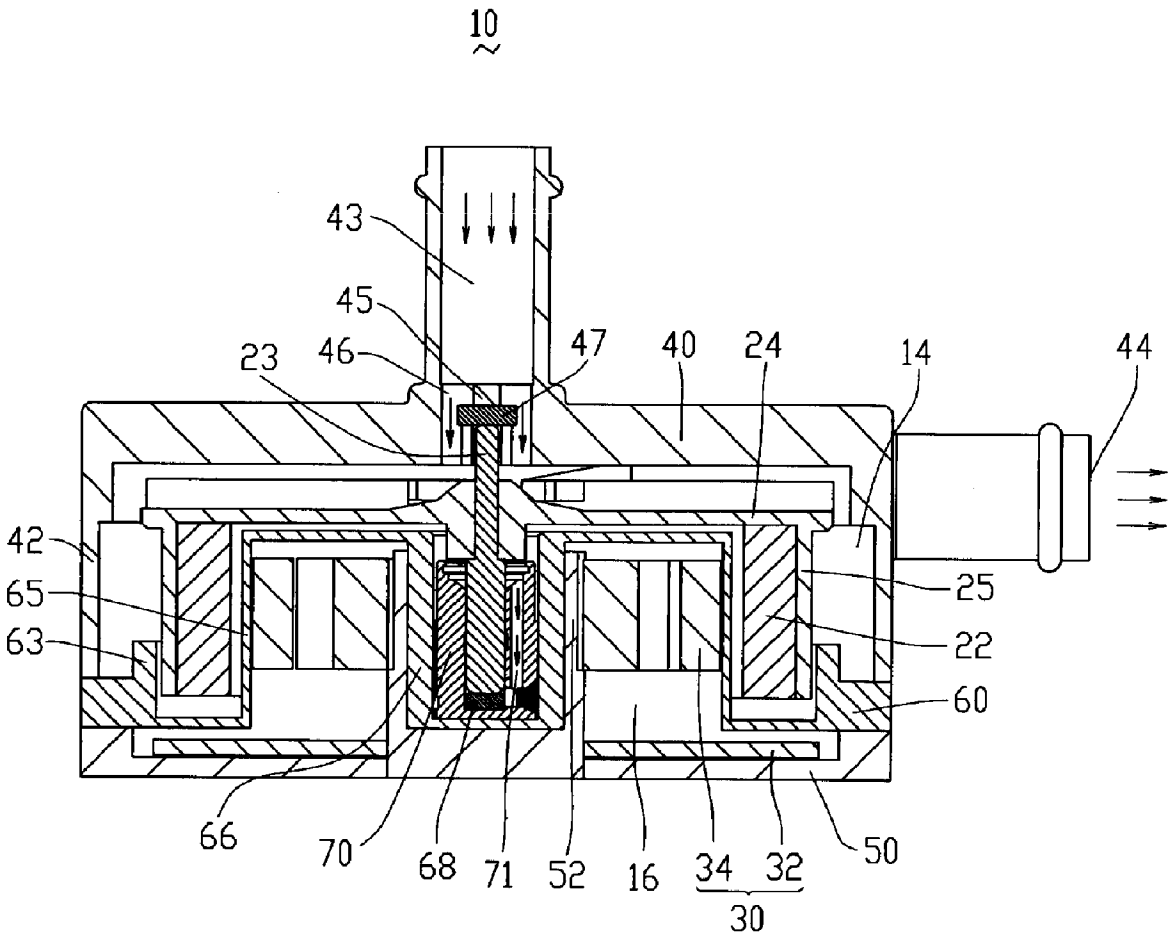
FIG. 3 is a cross-sectional view of the liquid pump of FIG. 2, taken along line III-III thereof.

Referring to FIGS. 1 to 3, a liquid pump 100 according to a preferred embodiment of the present invention is illustrated. The liquid pump 100 includes a pump body 10, a rotor 20 and a stator 30 disposed in the pump body 10.

The pump body 10 includes a top cover 40, a back plate 50, and a spacing member 60 sandwiched between the top cover 40 and the back plate 50. The spacing member 60 and the top cover 40 are mounted to the back plate 50 by a plurality of screws (not shown) extending through holes 12 defined in the top cover 40, back plate 50 and spacing member 60 of the pump body 10. Accordingly, an interior of the pump body 10 is divided into a fluid chamber 14 and a receiving cavity 16 isolated and hermetical from the fluid chamber 14. The fluid chamber 14 is disposed between the top cover 40 and the spacing member 60 with the rotor 20 received therein, while the receiving cavity 16 is disposed between the spacing member 60 and the back plate 50 with the stator 30 received therein.

The rotor 20 includes an impeller 21, an annular magnet 22, and a shaft 23. The impeller 21 includes a horizontal plate 24, and an annular supporting wall 25 extending downwardly from the horizontal plate 24. The magnet 22 engagingly abuts against an inner surface of the supporting wall 25. The shaft 23 vertically extends at a center of the rotor 20, having an upper section (not labeled) above a top face of the rotor 20 and a lower section (not labeled) within the supporting wall 25. The horizontal plate 24 defines a plurality of spaced channels 26 therein, thereby defining a plurality of spaced blades 27 thereon. The channels 26 extend radially outwardly from the center of the rotor 20. Rotation of the blades 27 is capable of driving working fluid into and out the fluid chamber 14. The stator 30 includes a circuit board 32 with a plurality of circuits (not shown) mounted thereon, and an armature 34 (coils wound around the armature 34 are not shown in FIG. 1 and FIG. 3) mounted on the circuit board 32. As the circuits on the circuit board 32 are activated, the coils of the stator 30 will generate an electromagnetic field, which exerts a force on the magnet 22 to push the impeller 21 of the rotor 20 to rotate in the fluid chamber 14.

The top cover 40 includes a base plate 41, and a housing 42 perpendicularly extending upwardly from the base plate 41 for enclosing the rotor 20 therein. The base plate 41 defines the holes 12 therein for assembling the pump body 10 of the liquid pump 100. The housing 42 defines an inlet 43 at a top portion thereof for inputting the working fluid and an outlet 44 perpendicular to the inlet 43 for outputting the working fluid. A blocking portion 45 defining a plurality of holes 46 therein is disposed at the inlet 43 of the housing 42 for passages of the working fluid. A first supporting plate 47 contacting with an inner surface of the blocking portion 45 is disposed at the inlet 43 of the housing 42 of the top cover 40 of the pump body 10 for supporting a top end of the shaft 23.

The spacing member 60 includes a partition plate 61, a shell 62 perpendicularly extending upwardly from the partition plate 61 for enclosing the stator 30 therein, and a ring-like flange 63 surrounding an outer periphery of the shell 62. The partition plate 61 defines the holes 12 therein for use in assembling the pump body 10 as mentioned above. The shell 62 includes a top plate 65, an annular wall 64 extending downwardly from an edge of the top plate 65 and offset inwardly a certain distance from the flange 63, and a hollow tube 66 extending downwardly from a middle portion of the top plate 65. The hollow tube 66 encloses a receiving space 67 for accommodating a fluid dynamic bearing (FDB) 70 therein. The bearing 70 has a U-shaped cross section. A second supporting plate 68 is disposed at a bottom end of the bearing 70 for supporting a bottom end of the shaft 23. A slot 71 is axially defined in a sidewall of the bearing 70, communicating an interior of the bearing 70 with an exterior thereof, to benefit the working fluid to enter into the interior of the bearing 70 and a clearance formed between the shaft 23 and the bearing 70 for generating a hydrodynamic pressure to push the shaft 23 away from an inner surface of the bearing 70 and lubricate the shaft 23 and the bearing 70 during rotation of the shaft 23. The magnet 22 and the supporting wall 25 of the rotor 20 are disposed in a space formed between the flange 63 and the annular wall 64 of the shell 62. The magnet 22 and the supporting wall 25 surround the annual wall 64 of the shell 62 of the spacing member 60, with the shaft 23 received in a bearing hole of the bearing 70. Thus, the rotor 20 is rotatably mounted to the bearing 70.

The back plate 50 includes a ground floor 51, and a central tube 52 perpendicularly extending upwardly from a middle portion of the ground floor 51. The ground floor 51 defines a depression 53 therein for accommodating the circuit board 32 of the stator 30. A diameter of an outer periphery of a top portion of the central tube 52 is substantially the same as a diameter of an inner hole of the armature 34. The stator 30 is engagingly mounted to the back plate 50 of the pump body 10 with the top portion of the central tube 52 fitting in the inner hole of the armature 34. A diameter of an inner periphery of the central tube 52 is substantially equal to that of an outer periphery of the hollow tube 66 of the spacing member 60, for engagingly receiving the hollow tube 66 in the central tube 52.

In assembly of the liquid pump 100, the stator 30 is mounted to the back plate 50 of the pump body 10, with the circuit board 32 received in the depression 53 and the central tube 52 engagingly received in the inner hole of the armature 34. The spacing member 60 is mounted to the back plate 50, with the hollow tube 66 engagingly received in the central tube 52. The bearing 70 is disposed in the receiving space 67 of the hollow tube 66. The rotor 20 is mounted to the spacing member 60, with the magnet 22 of the rotor 20 disposed between the annular wall 64 and the flange 63 of the spacing member 60, and the shaft 23 of the rotor 20 rotatably received in the bearing hole of the bearing 70. The top cover 40 is mounted to the spacing member 60, with the holes 12 of the top cover 40 aligning with the holes 12 of the spacing member 60 and the back plate 50. Finally, the screws (not shown) extend through the holes 12 of the pump body 10 to engage with nuts (not shown) to accomplish the assembly of the liquid pump 100.

In the present invention, the interior of the pump body 10 is divided into two isolated cavities, i.e., the fluid chamber 14 disposed the working fluid therein and the receiving cavity 16 received the stator 30 therein. The two cavities are hermetical from each other. Such design isolates the circuit board 32 of the stator 30, which is in the receiving cavity 16, from the working fluid in the fluid chamber 14, thereby preventing the stator 30 from being damaged due to short circuit of the circuits of printed circuit board 32 in the working fluid. The fluid dynamic bearing 70 is mounted to the fluid chamber 14 of the pump body 10. Thus, the working fluid is no only capable of generating dynamic pressure for the bearing 70, but also acting as lubricant for the bearing 70. As the liquid pump 100 is activated, the shaft 23 of the rotor 20 is pushed to space from the fluid dynamic bearing 70 by the dynamic pressure, which reduces friction generated between the shaft 23 and the bearing 70, thereby reducing the noise caused by friction and increasing the lifetime of the liquid pump 100.

In the present invention, the stator 30, the spacing member 60, the bearing 70, the rotor 20 and the top cover 40 are orderly mounted to the back plate 50 of the pump body 10. Preferably, the back plate 50 and the stator 30 may be preassembled, while the spacing member 60, the bearing 70, and the rotor 20 may also be preassembled and mounted to the preassembled back plate 50 and stator 30. In this embodiment of the present invention, the top cover 40, the spacing member 60 and the back plate 50 are screwed together. Alternatively, the spacing member 60 and the back plate 50 may be riveted together, or bonded together to realize the isolation of the fluid chamber 14 and the receiving cavity 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid pump assembly comprising:

a top cover;

a back plate; and a spacing member sandwiched between the top cover and the back plate, the spacing member dividing an interior of the liquid pump into a fluid chamber and a receiving cavity isolated and hermetical from the fluid chamber, the fluid chamber being disposed between the top cover and the spacing member for receiving therein a fluid dynamic bearing and a rotor which drives working fluid to enter and leave the liquid pump, the receiving cavity being disposed between the spacing member and the back plate for receiving therein a stator which drives the rotor to rotate in respective to the bearing;

wherein the bearing axially defines a slot in a sidewall thereof and wherein the working fluid flows through the slot into a clearance between the shaft and the bearing during operation of the liquid pump.

2. The liquid pump assembly of claim 1, wherein the rotor comprises an impeller, an annular magnet, and a shaft pivotably received in the bearing.

3. The liquid pump assembly of claim 2, wherein the cop cover disposes a first supporting plate therein for supporting a top end of the shaft, the spacing member disposes a second supporting plate therein for supporting a bottom end of the shaft.

4. The liquid pump assembly of claim 2, wherein the impeller comprises a horizontal plate, and an annular supporting wall extending downwardly from the horizontal plate, the magnet contacts with an inner surface of the supporting wall.

5. The liquid pump assembly of claim 4, wherein the horizontal plate disposes a plurality of spaced blades thereon.

6. The liquid pump assembly of claim 1, wherein a cross section of the bearing is U-shaped.

7. The liquid pump assembly of claim 1, wherein the spacing member disposes a hollow tube thereon for receiving the bearing therein, the back plate disposes a central tube thereon for receiving the hollow tube therein and mounting the stator thereon.

8. The liquid pump assembly of claim 7, wherein the spacing member includes a partition plate, a shell extending upwardly from the partition plate, and a flange surrounding an outer periphery of the shell, the shell includes a top plate, and an annular wall extending downwardly from an edge of the top plate and offset inwardly a distance from the flange, the hollow tube extends downwardly from a middle portion of the top plate.

9. A liquid pump comprising:

a rotor for driving working fluid to enter and leave the liquid pump;

a stator for driving the rotor to rotate in the liquid pump; and a spacing member hermetically isolating the rotor from the stator, the spacing member having a fluid dynamic bearing therein for rotatably supporting a shaft of the rotor, the bearing and the shaft defining a clearance therebewteen for accommodating the working fluid therein to generate dynamic pressure to support the rotor rotating in the bearing;

wherein the spacing member covers on a back plate to form a receiving cavity therebetween for receiving the stator therein; and wherein the spacing member comprises a hollow tube receiving the bearing therein, the back plate disposes a central tube thereon for receiving the hollow tube therein and mounting the stator thereon.

10. The liquid pump of claim 9, further comprising a top cover mounted on the spacing member, a fluid chamber is formed between the top cover and the spacing member for receiving the rotor, the working fluid, and the bearing therein.

11. The liquid pump of claim 9, wherein the spacing member disposes a shell around the stator.

12. The liquid pump of claim 11, wherein the rotor comprises an annular supporting wall, and a magnet contacting with an inner surface of the supporting wall, the supporting wall and the magnet are disposed around the shell.

13. The liquid pump of claim 9, wherein a cross section of the bearing is U-shaped.

14. A liquid pump assembly comprising:

a back plate;

a stator mounted on the back plate;

a spacing member mounted on the back plate and hermetically surrounding the stator;

a rotor mounted on the space member; and a top cover mounted on the spacing member and hermetically surrounding the rotator;

wherein the top cover defines a liquid inlet and a liquid outlet, working fluid entering the top cover via the liquid inlet and leaving the top cover via the liquid outlet when the rotor rotates relative to the stator;

wherein the rotor has a bearing received in the spacing member and a shaft rotatably fitted in the bearing, the bearing has a slot in a wall thereof, the working fluid flowing into a clearance between the shaft and the bearing via the slot when the rotor rotates in respective to the stator; and wherein the back plate has an upright tube, the stator being mounted on the tube and the bearing being located in the tube.

15. The liquid pump assembly of claim 14, wherein the rotor has an impeller with an annular supporting wall and a horizontal plate on a top of the supporting wall, a plurality of blades for driving the working fluid to flow being formed on a top face of the supporting wall, a magnetic being attached to an inner face of the supporting wall and surrounding the stator.

* * * * *